United States Patent [19]

Kametani

[11] 4,032,425

[45] June 28, 1977

[54] ELECTROLYTIC CELL FOR USE IN HYDROELECTROMETALLURGY

[75] Inventor: Hiroshi Kametani, Tokyo, Japan

[73] Assignee: National Research Institute for Metals, Tokyo, Japan

[22] Filed: Sept. 27, 1976

[21] Appl. No.: 726,956

[30] Foreign Application Priority Data

Sept. 30, 1975 Japan ..... 50-117146

[52] U.S. Cl. ..... 204/261; 204/222; 204/263; 204/273; 204/275

[51] Int. Cl.[2] ..... C25B 9/00; C25D 17/00; C25C 7/00

[58] Field of Search ..... 204/261, 263, 273, 275, 204/1 R, 106, 232, 222

[56] References Cited

UNITED STATES PATENTS

| | | | |
|---|---|---|---|
| 1,225,052 | 5/1917 | Piguet | 204/275 X |
| 2,099,290 | 11/1937 | Baird | 204/273 |
| 2,427,433 | 9/1947 | Winslow et al. | 204/263 X |
| 3,788,965 | 1/1974 | Holsinger | 204/261 X |

*Primary Examiner*—Howard S. Williams
*Assistant Examiner*—D. R. Valentine
*Attorney, Agent, or Firm*—Sherman & Shalloway

[57] ABSTRACT

An improved electrolytic cell for use in the continuous hydroelectrometallurgical production of a metal by the electrolytic deposition of the metal on the surface of suspended seed particles of pure metal comprising a vertical cylindrical cell comprising an upper anode zone including a horizontal anode and a lower cathode zone including a horizontal network cathode, said network cathode partitioning the cathode zone into an upper and a lower part, and a stirrer positioned below said network cathode. Thus, the seed particles are maintained in a stable state of suspension in the electrolyte in the upper part of the cathode zone, where they are electronegatively charged by their collision with the network cathode, with the consequence that the electrolysis is carried out with extreme effectiveness.

4 Claims, 1 Drawing Figure

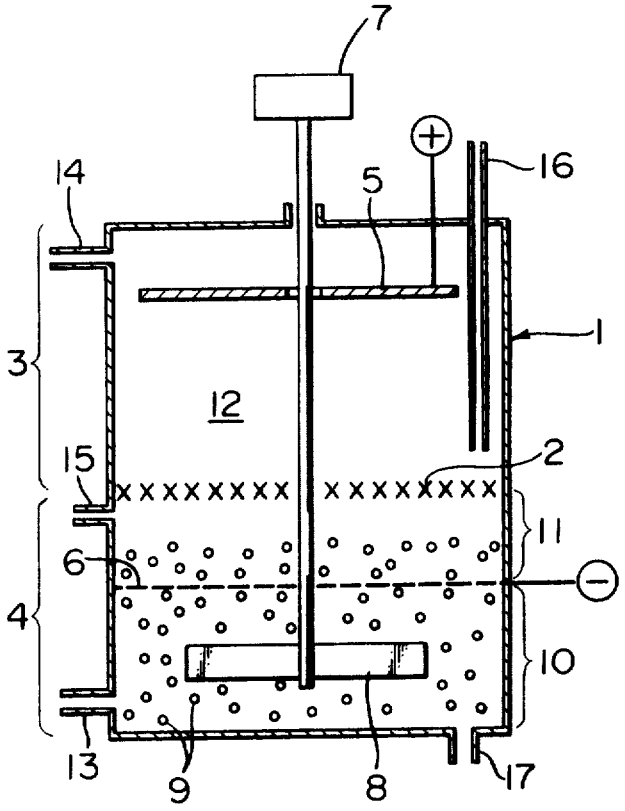
7
14
5
16
1
3
12
15
2
11
6
4
10
13
9
8
17

ELECTROLYTIC CELL FOR USE IN HYDROELECTROMETALLURGY

This invention relates to an improved electrolytic cell for use in the continuous hydroelectrometallurgical production of a metal by the electrolytic deposition of the metal on the surface of suspended seed particles of the pure metal.

Such a hydroelectrometallurgical method and apparatus for use in such a method has been disclosed by me in U.S. Pat. 3,787,293.

Hydroelectrometallurgy, as is well known, includes electrorefining and electrowinning. While the former is a method which comprises carrying out an aqueous electrolysis by using a crude metal containing impurities as an anode thereby depositing a pure metal on a cathode, the latter is a method which comprises carrying out the electrolysis by employing as the electrolyte a solution in which a metal has been dissolved in advance in the form of its ion thereby depositing the metal on a cathode and thereafter recovering same.

A new method for carrying out the hydroelectrometallurgy has been fully described in the aforesaid U.S. Pat. No. 3,787,293, which has been incorporated in the present invention by way of reference.

Such a method, in brief, comprises suspending particles of a starting crude metal or metal sulfide in the anode zone and seed particles of the pure metal in the cathode zone, causing said particles to collide with the surfaces of the anode and cathode, respectively, passing an electric current through said anode and cathode, the particles of the crude metal or metal sulfide being electropositively charged due to their collision with the anode and becoming dissolved in an electrolyte solution, the seed particles being electronegatively charged due to their collision with the cathode, whereby the metal ions in the electrolyte solution are cathodically deposited as the metal on said seed particles, and thereafter recovering from the cathode zone the enlarged metal particles which have grown as a result of said electrolytic deposition of the metal on the seed particles.

In the conventional hydroelectrometallurgical methods an anode plate and a cathode plate were suspended perpendicularly in an electrolyte solution and by passing an electric current between the two electrodes the metal was deposited on the cathode plate, after which the cathode plate was pulled up from the electrolytic cell and the deposited metal was recovered. In this case the current per square decimeter was restricted to about 2 –5 amperes, and the operation was carried out in a batchwise manner. As compared with such conventional methods, the above-mentioned new method possesses an exceedingly distinctive feature in that the pure metal is deposited on the seed metal particles that are kept in suspension in the cathode zone, after which the grown metal particles are recovered. Since the whole area of the suspended particles is far greater than that of an electrode plate, the electric currrent that can be applied is very great, say, more than 10 or 20 times that in the case of the conventional methods, with the consequence that the electrolysis rate can be greatly enhanced. Furthermore, the operation can be carried out continuously, since the feeding of the starting material and the recovery of the resultant grown particles of pure metal can be carried out in a continuous manner. Again, it is possible to employ an electrolytic cell of the closed type. Hence, there is the advantage that the dissipation of a mist of the electrolytic solution that occurs in the case of the conventional methods can be prevented. All metals usable in the conventional hydroelectrometallurgy can be applied to the new method, and good results are obtained. More specifically, the metals exhibiting a standard electrode potential exceeding -1 volt (at 25° C.) such as zinc, iron, cobalt, nickel, tin, lead and copper are applicable to the new method.

In the aforementioned patent there is described an electrolytic cell that can be used in practicing the new method. FIG. 2 accompanying said patent shows a side view in section illustrating one embodiment of an electrolytic cell. This electrolytic cell comprises an upper anode zone including a horizontal anode and a lower cathode zone including a horizontal cathode and is fixed on a base frame on which vibration generators are mounted to give a composite vibration to the whole cell and the seed particles in the electrolyte thereby causing said particles to collide with the cathode. This composite vibration consists of a horizontal oscillation and an up-and-down vibration in the vertical plane. In order to generate this composite vibration, there is used an oscillating mechanism comprising two or more eccentric cams, transmission means, reducing gears and a driving motor, and a vibrator for generating a vertical vibration. Thus, there is the drawback that substantially complicated vibrating devices are required in the case of this electrolytic cell. Hence, an improved electrolytic cell free of such a drawback is desired.

The object of the present invention is therefore to provide an improved electrolytic cell that can be used effectively as an electrolytic cell in the new hydroelectrometallurgical method disclosed in the aforementioned patent.

According to the present invention, there is provided an improved electrolytic cell for use in the continuous hydroelectrometallurgical production of a metal by the electrolytic deposition of the metal on the surface of suspended seed particles of pure metal comprising a. a vertical cylindrical cell comprising an upper anode zone including a horizontal anode and a lower cathode zone including a horizontal network cathode, said network cathode partitioning the cathode zone into an upper and a lower part,
b. a stirrer positioned below said network cathode for agitating the electrolyte to maintain said seed particles contained therein in a suspended state within said cathode zone,
c. an inlet for charging into the cathode zone the electrolyte and the seed particles on which surface the metal is to be electrolytically deposited from the electrolyte,
d. an outlet for discharging the spent electrolyte from the anode zone,
e. an outlet for discharging and recovering from the cathode zone the enlarged metal particles which have grown as a result of the hereinbefore-described electrolytic deposition of the metal on the surface of the seed particles, and
f. means for passing an electric current between the anode and the cathode.

The most improtant feature of the electrolytic cell of the present invention resides in the fact that it possesses a horizontal network cathode by which the cathode zone is partitioned into an upper and lower part and, furthermore, there is provided a stirrer below said network cathode. Notwithstanding such a relatively simple setup, in the case of the vertical cylindrical electrolytic cell of this invention the seed particles, as a result of the conjoint action of the network cathode and the stirrer, are maintained in a stable state of suspension in the electrolyte and by their collision with the cathode become electronegatively charged. Hence, the electrolysis is carried out very effectively.

Preferred embodiments of the invention electrolytic cell will be more fully described below by reference to the accompanying drawing, which is a side view in section illustrating one of such embodiments.

In the figure the reference numeral 1 indicates the vertical cylindrical electrolytic cell in its entirety, in which upper anode zone 3 there is provided a horizontal anode 5, while its lower cathode zone 4 is provided with a horizontal network cathode 6. The network cathode 6 is positioned at a midpoint relative to the height of the cathode zone 6 and extends over the entire horizontal plane of the cathode zone thereby partitioning the cathode zone into an upper part 11 and a lower part 10. In the lower part 10 below the network cathode there is provided a stirrer 8 that is driven by a motor 7. It is also possible to provide the motor 7 below the electrolytic cell. In carrying out the electrolysis, the seed particles 9 and electrolyte 12 are continuously fed to the lower part of the cathode from an inlet 13, and the seed particles are kept in suspension in the electrolyte by the rotation of the stirrer 8 to become dispersed inside the lower part 10 and upper part 11 of the cathode zone. While the seed particles present in the lower part 10 are in a state of intense agitation as a result of being directly subjected to the agitation of the stirrer, those seed particles that are present in the upper part 11 are held in a gentle state of agitation as a result of being decelerated rheologically by the physical resistance of the network cathode, with the consequence that the suspension layer formed is stable and of relatively low height. The suspended seed particles, which consist of fine particles of a pure metal of the same class as that to be electrolytically deposited, collide with the network cathode and become electronegatively charged. As a consequence, the electrolytic deposition of metal on the surface of the seed particles is set up in the upper part 11 of the cathode zone, with the consequence that the particles gradually grow into coarse particles. The grown metal particles of increased size tend to gravitate to the lower part 10 of the cathode zone. Hence, the grown particles of the upper part 11 become replaced by the fine particles that are present in the lower part. The grown particles are continuously withdrawn from the bottom of the electrolytic cell via an outlet 17 and recovered. The fine particles and electrolyte that are discharged by entrainment in the grown particles are separated from the grown particles and can then be recycled to the cathode zone.

The reference numeral 2 in the figure represents a water-permeable diaphram, e.g., a diaphragm of a filter cloth or asbestos, or a water-impermeable diaphram, e.g. an ion-exchange resin membrane. The hydroelectrometallurgy by electrowinning, i.e., electrolysis by employing as the electrolyte a solution in which a metal has been dissolved in advance in the form its ion, does not require a diaphragm. In general, it is believed that the use of a diaphragm is not preferred, because it increases the electric resistance and thus increases the cell voltage between the two electrodes. Accordingly, in the methods, only when the insoluble residue containing impurities is formed on the anode and floats in the electrolyte is there used a diaphragm to prevent such a floating residue from contaminating the pure metal deposited in the cathode zone.

In carrying out the electrolysis without the use of a diaphragm or with the use of a water-permeable diaphragm, the spent eletrolyte is discharged from an outlet 14 located at the upper part of the anode zone. The discharged electrolyte can, as required, be recycled to the cathode zone via the inlet 13 after its purification. In the case of electrorefining in which a diaphragm is required, the anode itself can be the crude metal. Again, as disclosed in the aforementioned patent, the electrolysis can be carried out by causing the fine particles of the starting crude material, i.e., fine particles of the crude metal or fine particles of metal sulfide and the electron carrier metal, suspended in the anode zone to become electropositively charged by their collision with the surface of the anode. In this case, it is necessary to provide a stirrer in the anode zone for achieving the suspension of the particles and their collision with the anode. In the electrolysis in which a water-impermeable diaphragm is used, an inlet 16 for feeding an anolyte into the anode zone must be provided in addition to the foregoing inlet 13. Furthermore, in addition to the foregoing outlet 14, an outlet 15 must be provided for discharging the spent catholyte from the cathode zone.

While the setup of the invention electrolytic cell has been described hereinabove, its preferred embodiment will be more fully described below.

There is imposed no restriction as to the size of the seed particles used, and the seed particles may be of any size that can be suspended in the electrolyte by stirring. However, the seed particles are preferably of small size, and usually seed particles of a size ranging from about 0.05 millimeter to about 2 millimeters are used.

In the case of electrolytic cell of the present invention, the network cathode 6, as can be appreciated from the description given above, is not adapted for depositing on the surface thereof of the metal to be recovered but functions to impart an electronegative charge to the seed particles that collide therewith. As regards the material to be used for the cathode, a suitable metal is chosen in consideration of such factors as corrosion resistance, resistance to attrition and electroconductivity. Usually, most to be preferred is the use of titanium. The size of the mesh of the cathode is suitably about 5 millimeters to about 10 millimeters as a rule. When the meshes are too small, the seed particles experience difficulty in migrating from the lower part 10 of the cathode zone to its upper part 11. On the other hand, when the meshes are too large, the frequency of collision of the seed particles that are present in the upper part 11 with the network cathode declines, and satisfactory results cannot be obtained.

The stirrer 8 is made of a nonconductive, corrosion resistant material. As the shape of the vane, one which can effect the uniform dispersion of the seed particles is chosen, it being preferably one not imparted a twist but of a flat boardlike form. The size of the vane is usually such that its length in the transverse direction extends almost to the side walls of the lower part 10 of the cathode zone and its upper edge reaches to within several millimeters of the underside of the network cathode. The speed at which the stirrer is rotated is one which forms a relatively thin suspension layer of the seed particles, i.e., a suspension layer of relatively low height, in the upper part 11 of the cathode zone, i.e., above the network cathode. In general, the thickness of the suspension layer is preferably from about 1.0 centimeter to about 2 centimeters in the case of a small-size electrolytic cell. When the electrolytic cell is of large scale, the thickness of the suspension layer will vary somewhat. When the thickness of the suspension layer becomes too great, a decline takes place in the frequency with which the seed particles cellide with the network cathode, with the consequence that the number of particles becoming electronegatively charged decreases to cause a decline in the electrolytic efficiency. The rotating speed of the stirrer for forming a suspension layer of the seed particles of a suitable thickness above the network cathode will vary in accordance with the size of the stirrer vane, the size and specific gravity of the seed particles, the size of the meshes of the cathode, the diameter of the electrolytic cell, the amperage of the electric current, etc. A suitable rotating speed can be determined by a preliminary test. In general, this will be in the range of 50 – 1000 rpm.

The electrolytic cell, when viewed as a whole, has the shape of a vertical cylinder. The distance between the anode and cathode should be made as small as possible for reducing the electric resistance. Hence, the larger the scale of the electrolytic cell, the smaller the height to diameter ratio. Thus, the cell becomes as a whole one having a cylindrical shape in which the height is less than the diameter. As can be appreciated from what has been described hereinbefore, the total surface area of the seed particles that are electronegatively charged by the collision of the seed particles with the network cathode 6 is far greater than the surface area of the conventional cathode plate. Hence, the current density that can be applied per unit area of the horizontal section of the cathode zone 4 is far greater than that of the conventional method. This is equally applicable in the case of the anode zone in the case of electrorefining, which is carried out by suspending fine particles of the starting material in the anode zone and causing the collision of said particles with the anode. However, in the case of electrowinning, i.e., where the electrolysis is carried out by employing as the electrolyte a solution in which a metal has been dissolved in advance in the form of its ion, a suitable current density should be applied in accordance with the surface area of the anode used. In this case, usable is a cylindrical cell consisting of an upper anode zone having a diameter which makes it possible to accomodate an anode having a surface area suitable for the electric current to be applied and a lower cathode zone of a diameter smaller than that of the upper anode zone.

As the electrolyte, those used in the conventional electrolytic processes can be used. The concentration of the metallic ions is usually at least few grams per liter.

The most important feature of the invention electrolytic cell, which has been fully described hereinbefore as to its setup and method of operation, resides in the fact that it has made possible the suspension of seed particles in the cathode zone and the formation of a stable suspension layer of seed particles which collide with the cathode above the network cathode, this having been achieved by the conjoint effects of having made the electrolytic cell in a horizontal cylindrical form, using a network cathode and the provision of a stirrer therebelow. The setup of this electrolytic cell is exceedingly simple, and its operation is also very easy. In addition, a current of large amperage can be passed therethrough, and the electrolysis can be smoothly carried out continuously with high efficiency. The electrolytic cell described in the aforementioned patent, in which the seed particles are kept in suspension by oscillation, is of a complicated setup. Again, in the case of the conventional method in which the seed particles of the metal and the electrolyte were merely stirred with the rotating vane, the following difficulties were experience. When the speed of the rotating vane was increased, the seed particles of the metal would be localized in the vicinity of the inside wall of the electrolytic cell, owing to the strong centrifugal force acting on the seed particles. On the other hand, when the speed of rotation of the vane was reduced, it would be impossible to maintain the suspension in a stable state. Further, when there is a change in, say, the specific gravity of the seed particles, their particle size and amount charged, or the specific gravity of the electrolyte and its viscosity, the adjustment becomes troublesome. However, in case of the present invention, the tolerances with respect to the changes in these factors is extremely broad. Hence, the present invention has made it possible to overcome the shortcomings of the conventional methods.

The following examples, while not intended to be limiting, will serve to further illustrate the present invention. In all the examples, an electrolytic cell of small size was used, and for brevity edxperiments illustrating the case of electrowinning of copper were carried out. In these examples the experiments were carried out while varying the rotating speed of the stirrer, the size of the seed particles and the cell current. As a consequence, it was found that when a stable suspension layer of the seed particles was formed above the network cathode and that when the thickness of this suspension layer was about 1 – 2 centimeters, and particularly about 1 – 1.5 centimeters, a most satisfactory current efficiency was achieved.

EXAMPLE 1

An electrolytic cell consisting of an upper anode zone having a height of 10 centimeters and an inside diameter of 14 centimeters and including a copper anode of 1.5 square decimeters and a lower cathode zone having a height of 8 centimeters and an inside diameter of 6 centimeters and including a network cathode made of a titanium lath and a stirrer therebelow was used. The size of the meshes of this cathode is 10 millimeters, and this cathode is installed at a height 2.5 centimeters from the bottom of the cell. To the shaft of th stirrer are fitted at the same height four vanes having the dimensions in the lateral direction of 2.5 centimeters and in the vertical direction of 1.8 centimeters. This electrolytic cell was filled with an electrolyte having a concentration of 50 grams of $Cu^{++}$ per liter and 100 grams of $H_2SO_4$ per liter. This was followed by charging 350 grams of seed particles of pure copper of 32 – 48 Tyler mesh size to the cathode zone. The electrolysis was then carried out at a temperature of room temperature to 60° C by passing a 5-ampere current between the electrodes while operating the stirrer. The thickness of the suspension layer of seed particles formed above the network cathode and the current efficiences with respect to the deposition of copper on the seed particles and the network cathode are shown in Table 1, below.

Table 1

| Speed of Stirrer (rpm) | Thickness of Suspension Layer (cm) | Current Efficiency (%) | |
|---|---|---|---|
| | | Seed Particles | Cathode |
| 305 | 1.0 | 96.6 | <0.01 |
| 403 | 1.1 | 96.1 | 0.08 |
| 499 | 1.5 | 95.3 | 0.2 |
| 640 | 2.4 | 90.3 | 3.7 |

It can be appreciated from this table that at a rotating speed of the stirrer of about 300 – 400 rpm there was formed a suspension layer having a thickness of about 1 centimeter above the cathode and that the current efficiency obtained as excellent, whereas when the rotating speed exceeded about 600 rpm the thickness of the suspension layer became greater than about 2 centimeter and there was a slight decline in the amount of copper deposited on the seed particles, while there was an increase in the amount of copper deposited on the cathode.

In this electrolysis it was seen that the suspension layer was stably obtained above the network cathode and that the particles in this suspension layer were circulating within the cell at a slow speed of about 40 – 120 rpm while colliding with each other.

EXAMPLE 2

An electrolytic cell of the same type as that used in Exapmle 1 was employed, and the electrolysis was conducted under identical conditions as indicated therein, except that the particle size of the seed particles of copper was varied as shown in Table 2. The optimum rotating speed of the stirrer, the thickness of the suspension layer above the network cathode, and the current efficiencies with respect to the deposition of copper on seed particles and the network cathode are shown in Table 2.

Table 2

| Size of seed Particles of Copper (mesh) | Stirrer Speed (rpm) | Thickness of Suspension Layer (cm) | Current Efficiency (%) | |
|---|---|---|---|---|
| | | | Seed Particles | Cathode |
| 32 -48 | 305 | 1.2 | 96.6 | <0.01 |
| 70 -80 | 396 | 1.2 | 98.2 | 0.08 |
| 100 -150 | 388 | 1.3 | 96.3 | 0.09 |

It can be seen from these results that when the rotating speed of the stirrer is about 300 – 400 rpm suspension layers having thicknesses of about 1 – 1.3 centimeters are formed, and that thus it is possible to carry out the electrolysis stably using copper powders of varying particle size with practically no change in the rotating speed of the stirrer, if the other conditions of the electrolysis are the same.

EXAMPLE 3

The experiment was conducted using an electrolytic cell of the same type as that used in Example 1 but varying, as shown in Table 3, the cell current, and hence the current density per unit horizontal sectional area of the cathode zone. Seed particles of copper of 32 – 48 mesh size were used in an amount of 350 grams. Since the rise in the inside temperature of the cell was excessive when the cell current was 10 amperes or higher, the electrolysis was carried out by cooling the electrolyte by circulating it through a separate cooling tank. The results obtained are shown in Table 3, below.

Table 3

| Cell Current (amp) | Current Density (amp/dm²) | Electrolyte Circulation (ml/min.) | Temperature (° C.) | Stirrer Speed (rpm) | Current efficiency (%) | |
|---|---|---|---|---|---|---|
| | | | | | Seed Particles | Cathode |
| 5 | 17.8 | — | 63.5 | 403 | 96.1 | 0.08 |
| 10 | 35.7 | 80 | 61.0 | 452 | 97.9 | 0.14 |
| 20 | 71.4 | 250 | 60.5 | 500 | 99.4 | 0.14 |
| 30 | 107.1 | 250 | 67.5 | 617 | 95.8 | 0.10 |

It can be seen from the results given in the foregoing table that it is possible to carry out the electrolysis very effectively with an exceedingly high current density when the electrolytic cell of the present invention is used, and that at high current densities the rotating speed of the stirrer is preferably increased somewhat.

What is claimed is:

1. An electrolytic cell for use in the continuous hydroelectrometallurgical production of a metal by the electrolytic deposition of the metal on the surface of suspended seed particles of pure metal comprising
   a. a vertical cylindrical cell comprising an upper anode zone including a horizontal anode and a lower cathode zone including a horizontal network cathode, said network cathode partitioning the cathode zone into an upper and a lower part,
   b. a stirrer disposed below said network cathode for agitating the electrolyte to maintain the seed paticles contained therein in a suspended state within said cathode zone,
   c. an inlet for charging into the cathode zone the electrolyte and the seed particles on which surface the metal is to be electrolytically deposited from the electrolyte,
   d. an outlet for discharging from the anode zone the spent electrolyte,
   e. an outlet for discharging and recovering from the cathode zone the enlarged metal particles which have grown by the aforesaid electrolytic deposition of the metal on the surface of the seed particles, and
   f. means for passing an electric current between the anode and the network cathode.

2. An electrolytic cell of claim 1 which further includes a diaphragm that separates said upper anode zone from said lower cathode zone.

3. An electrolytic cell of claim 2 which further includes in said anode zone a stirrer for agitating the electrolyte to maintain the fine particles of a starting crude material contained therein in a suspended state within said anode zone.

4. An electrolytic cell of claim 3 wherein said diaphragm is a water-impermeable diaphragm and which further includes an inlet for charging the anolyte to the anode zone and an outlet for discharging the spent catholyte from the cathode zone.

* * * * *